US006199661B1

(12) United States Patent
Kumar

(10) Patent No.: US 6,199,661 B1
(45) Date of Patent: Mar. 13, 2001

(54) TOP-OF-RAIL LUBRICATION RATE CONTROL BY THE HYDRAULIC PULSE WIDTH MODULATION METHOD

(75) Inventor: Sudhir Kumar, Darien, IL (US)

(73) Assignee: Tranergy Corporation, Bensenville, IL (US)

( * ) Notice: Subject to any disclaimer, the term of this patent is extended or adjusted under 35 U.S.C. 154(b) by 0 days.

(21) Appl. No.: 09/595,261

(22) Filed: Jun. 15, 2000

Related U.S. Application Data

(63) Continuation of application No. 09/046,195, filed on Feb. 23, 1998, now Pat. No. 6,076,637.

(51) Int. Cl.[7] ..... B61K 3/02

(52) U.S. Cl. ..... 184/3.2; 184/3.1; 188/38; 222/54; 222/399

(58) Field of Search ..... 184/3.2, 3.1; 188/38, 188/35, 41; 105/73; 137/209; 141/67, 83, 94; 222/54, 399, 394

(56) References Cited

U.S. PATENT DOCUMENTS

| | | | | |
|---|---|---|---|---|
| 3,599,753 | * | 8/1971 | Walsh | 184/15 A |
| 4,425,986 | * | 1/1984 | Wedlin | 184/3.2 |
| 6,076,637 | * | 6/2000 | Kumar | 184/3.2 |

* cited by examiner

*Primary Examiner*—David Fenstermacher
(74) *Attorney, Agent, or Firm*—Cook,Alex,McFarron, Manzo,Cummings & Mehler, Ltd.

(57) ABSTRACT

A lubrication system for a railroad locomotive applies a lubricant with great accuracy in computer-controlled, precise quantities behind the last axle of the last locomotive such that the lubricant is consumed by the time the entire train has passed under all track, speed, temperature and train size conditions. Hydraulic pulse-width modulation (PWM or %PWM) controls the quantity of lubricant delivered. Time is divided into a series of windows each consisting of a few seconds. Lubricant delivered from a pressurized tank through long hoses to a solenoid controlled valve is then metered by the duration within this time window for which the computer computes and opens the valve. Compensation is provided for train tonnage and lubricant temperature as well as track curvature and train speed.

8 Claims, 5 Drawing Sheets

TOP-OF-RAIL LUBRICATION RATE CONTROL BY THE HYDRAULIC PULSE WIDTH MODULATION METHOD

CROSS REFERENCE TO RELATED APPLICATION

This application is a continuation of application Ser. No. 09/046,195, filed Feb. 23, 1998, now U.S. Pat. No. 6,076,637.

BACKGROUND OF THE INVENTION

Kumar and Kumar (U.S. Pat. No. 4,390,600) invented an intelligent on-board lubrication system for curved and tangent track. They proposed a method of applying the lubricant to the rail by using a separate spring loaded lubrication wheelset to which the lubricant is applied first. This wheelset then applies the lubricants to the rail. The rate of lubricant application is controlled by a microprocessor and a number of operating parameters of the train and the track on which it is operating. Kumar and Kumar later invented a method of applying the lubricants directly to the rail (U.S. Pat. No. 5,477,941). In this invention they proposed to apply two lubricants, one Top-of-Rail (TOR) and another Rail Gage Side (RAGS). In both inventions, the computer logic controlling the rate of lubrication was the same. The rate of lubrication R, was controlled by the relation $R=K*R_D*R_L*V*Nw$ where K is an equipment factor constant; $R_D$ is a curve factor based on the relation $R_D=K_D*D$ ($K_D$ is a constant and D is the degree of the rail curve); $R_L$ is a lubricant factor based on $R_L=C_L*T$ ($C_L$ is a constant and T is the ambient temperature); V is the train velocity; N is the number of car axles and w is the average tons/car axle; i.e. Nw represents the total trailing car tons of the train. The above inventions advanced the state of the art in rail lubrication significantly. However, a number of new advances have been made recently. These are subjects of the present invention.

SUMMARY OF THE INVENTION

This invention uses only Top-of-Rail (TOR) lubrication on both rails without rail gage side (RAGS) lubrication. The TOR lubricant is applied with great accuracy in computer-controlled, precise quantities behind the last axle of the last locomotive such that the lubricant is consumed by the time the entire train has passed under all track, speed, temperature and train size conditions. For a TOR lubrication system, it is important that the lubricant is computed and applied accurately so that no lubricant is wasted, maximum benefit is achieved and no lubricant is left on the rail after the train has passed. This invention therefore makes use of a technique referred to henceforth as the hydraulic pulse-width modulation method (PWM or %PWM) that controls the quantity of lubricant delivered. This method is much more accurate than the various conventional pumps. This method is also cheaper and has a much higher reliability, because it uses only one moving part. In this method, time is divided into a series of windows each consisting of a few seconds. Lubricant delivered from a pressurized tank through long hoses to a solenoid controlled valve is then metered by the duration within this time window for which the computer computes and opens the valve.

Because of the wide temperature range encountered in railroad operations, the lubricant viscosity can change significantly. These viscosity changes, coupled with the long hoses needed in a locomotive, can cause large variations in the hose resistance to lubricant flow. These variations must be compensated for to obtain the correct lube delivery rate. This invention therefore provides a viscosity/temperature compensation method in which a viscosity versus temperature curve of the lubricant along with some field tests provide a correlation in the open time of the solenoid valve (%PWM) in each time window so that the design value of the lubricant is delivered to the rail even though lubricant temperature may vary through a broad range.

If the temperatures fall to very low values, insufficient lubricant comes out of the nozzles even with the solenoid valves fully open in all time windows. This invention then uses an electronic or electromechanical pressure regulator to change the pressure in the tank to let enough lubricant flow under low temperature conditions.

This invention also defines a method of more accurately determining the effect of tonnage in the train on the rate of lubrication. It involves experimentally measuring the rail head adhesion coefficient after the train has passed for several rates of lubrication for each tonnage train. For the correct lubrication rate for a given tonnage train, the adhesion coefficient on the rail after the train has passed, will be above 80% of the value achieved on a clean dry rail. These values are tabulated for each tonnage and the table is stored in the memory of the locomotive's computer for calculation. Before starting the train, the engineer enters the tonnage of the train on the computer keypad. The computer then uses the internal table to select the proper correction factor for tonnage.

The present invention also uses a new logic for turning off the lubrication when dynamic or air brakes are applied on a train. By using this new invention, the intelligent rail lubrication method can be made more economical, more effective, more accurate, and more reliable.

The improved equation for the application of the lubricant to the top of the rails is:

$$\%PWM=K*R_D\cdot f_1(T_L)*V*f_2(W)$$

where $f_1(T_L)$ is a function of lube temperature and $f_2(W)$ is a function of train tonnage.

DETAILED DESCRIPTION OF THE INVENTION

In this rail lubrication system, the lubricant is applied to the rail almost continually on tangent as well as curved track. It is desirable to use the least quantity of lubricant that is necessary under all track, speed, temperature and train size considerations, to keep the cost of operation small. The present invention has therefore developed several new methods to accurately determine the minimum quantity of lubricant needed and to apply it to the rail precisely with the help of a computer.

Figure 1:
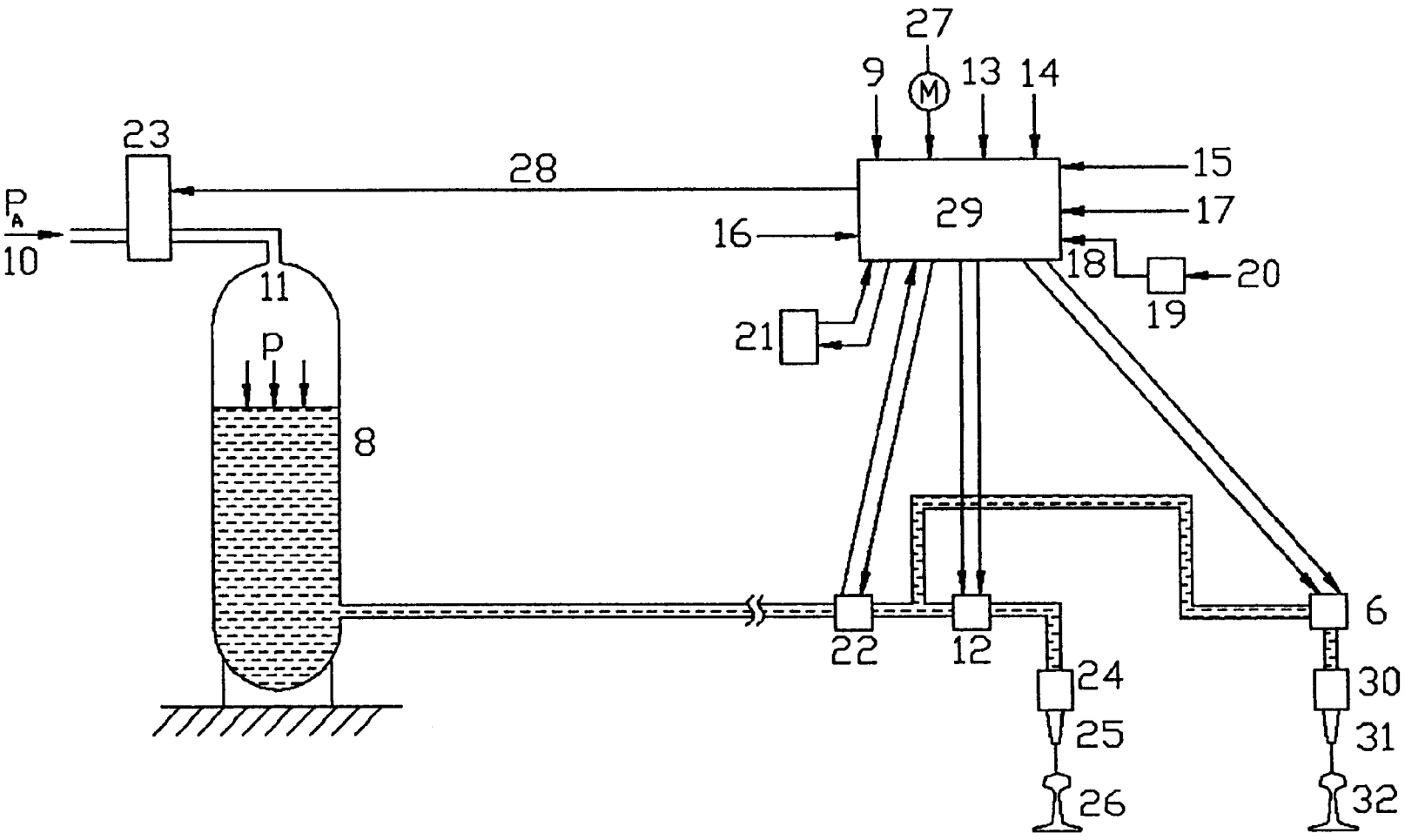
FIG. 1 is a schematic diagram of the computer control of the rate of lube application to the two rails.

FIG. 1 shows the general schematic diagram of the TOR lubricant application system according to the present invention. The computer 29 receives the inputs and controls the lubricant application. The lubricant is kept in a tank or reservoir 8 which is pressurized at a pressure "p" regulated by a regulator 23. The air for pressurization is taken from the compressed air supply 10 of the locomotive which is at a higher pressure "$P_A$" than the pressure "p" required by the lube tank. The lubricant flows through long hoses or conduits to reach the applicator nozzles, 25 and 31, applying lube to the top of the two rails 26 and 32. The computer 29 receiving regulated and isolated voltage/power from the locomotive 9, gathers the operating input data and controls the lube application rate. Many of the computer inputs are the same as in the aforementioned two U.S. Pat. Nos. 4,390,600 and 5,477,941, the disclosures of which are incorporated herein by reference. These are: train speed 13, curve sensor 14, direction of travel 15, rain sensor 16, ambient temperature 21 and manual input of trailing tons of cars 27M. An important input that is needed is the temperature of the lubricant. The viscosity of the lubricant changes significantly with temperature. The lubricant temperature is measured by sensor 22 placed in the flow line. A change in temperature changes the flow rate resulting in deviations from the design value. The flow rate must be kept close to the design value for consumption of the lubricant. This part of the invention will be discussed later. The improved equation for TOR lube flow rate is $R=K*R_D*f_1(T_L)*V*f_2(W)$.

One difficulty which can develop in low temperatures is that the lube may not flow adequately when it is very cold and viscous. To overcome this eventuality, this invention makes use of an output signal 28 from the computer to a pressure regulator 23 which can change the pressure in the tank to a higher value suitable for the colder temperature. Thus, the flow can continue according to the design values even for colder temperatures. An electronic pressure regulator can be used for this purpose. These regulators are relatively expensive and so a different approach using two conventional regulators can be followed as discussed later.

Another input that has been added in this invention is the application of the dynamic brake 17 and the development of new logic for the application and release of the automatic/air brake 18. A pressure transducer 19 which measures the air brake pressure 20 and new logic are used for this purpose, as will be explained below.

An important part of this invention is the use of the hydraulic pulse width modulation technique. The solenoid valves 12 and 6, normally used as devices for opening or shutting off flow for pneumatic or hydraulic circuits, are used in this invention as devices to control flow precisely with a computer while using only one moving part in each line. To maintain quick hydraulic response at the delivery ends 25, 31, check valves 24, 30 are necessary to prevent lubricant in the hoses between the solenoid valves and nozzles from dripping when the solenoid valves are closed.

Figure 2:
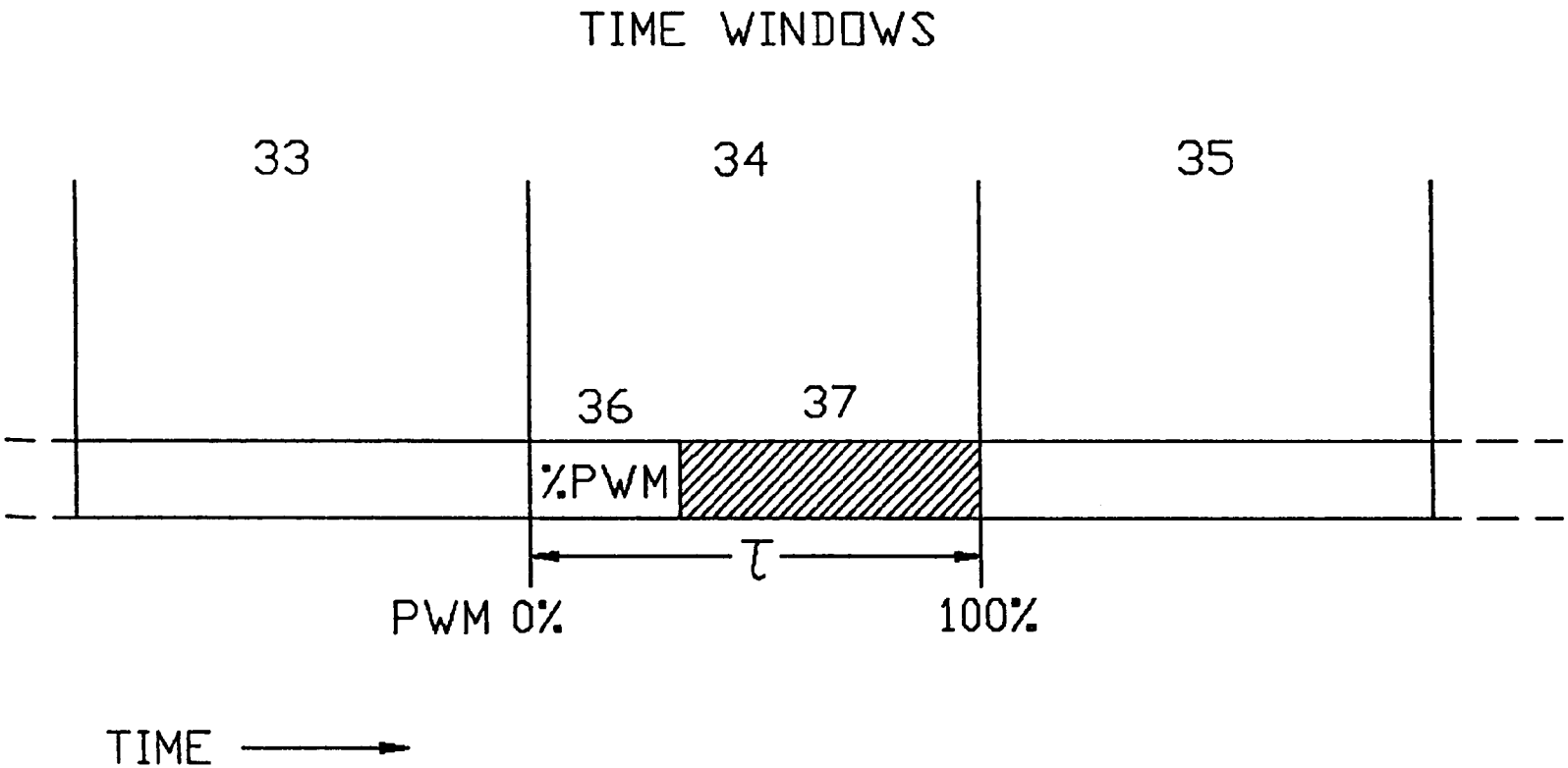
FIG. 2 shows the hydraulic pulse width modulation (PWM or %PWM) concept time windows.

The hydraulic pulse width modulation technique of flow control is explained conceptually in FIG. 2. The computer logic divides time into sequential time windows of a few seconds each. The time window can be even less than one second if so desired but this time should not be comparable to the time required by the solenoid to open and close. FIG. 2 shows three time windows 33, 34, 35 of period $\tau$ each. Window 34 is the present window, 33 is the window just completed and 35 is the next window. For each window, based on the inputs, the computer determines the duration %PWM 36 for which the solenoid valve is to be opened. It is shut for the duration 37. For the purpose of computation, the window is divided into multiple sections. For example, a 16-bit CPU will provide 32,768 parts. Therefore, the accuracy with which %PWM is calculated is very high. The amount of lubricant that will flow through the solenoid valve depends on this duration of time for %PWM. Other parameters that affect the flow volume are pressure "p" in the lube tank, lube temperature/viscosity and the hose length between the tank and the nozzle. Tank pressure is kept at a design value. Therefore, %PWM can then be adjusted by software so that the flow will be the design value even with a change in lube temperature. By using this method, great accuracy as well as high reliability (because there is only one moving part in the solenoid) are achieved.

Figure 3:
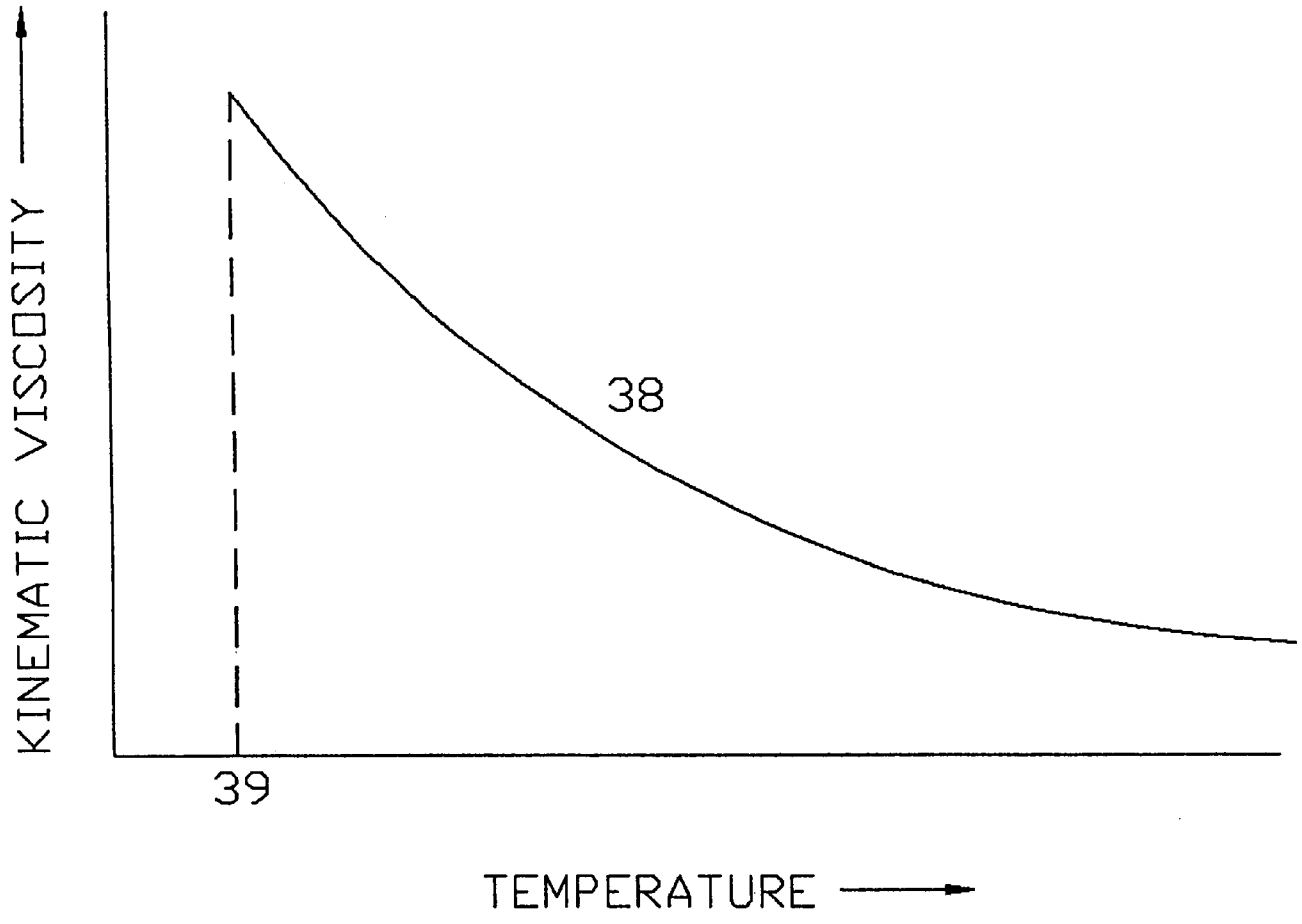
FIG. 3 is a typical viscosity versus temperature plot for a lubricant.

FIG. 3 shows a typical kinematic viscosity versus temperature plot 38 of a lubricant. The lubricant will not flow readily below its pour point temperature 39. Such a diagram needs to be determined experimentally for the lubricant to be used for developing a change in %PWM of FIG. 2 to account for a change in lube temperature. The lube flow in the hoses is laminar because the critical Reynolds number is not exceeded. For this case, the pressure drop due to viscous friction is proportional to kinematic viscosity (FIG. 3). The flow increases with reduced viscosity at warm temperatures and it reduces with increased viscosity at cold temperatures. A correction of %PWM is therefore necessary to ensure that the same flow develops at all temperatures.

It is necessary to conduct at least three flow tests to determine the effect of temperature and viscosity on flow and then make a correction for the temperature effect. One of these tests is at room temperature (70° F.), one at cool or low temperatures (such as 20° F.) and the last at warm temperatures (such as 120° F.). Measure the flow at a given %PWM (such as 50%) for the three temperatures. If the flow for the three temperatures are F(room), F(cold) and F(hot), the correction for flow is made by adjusting the temperature factor by 1 for F(room), by F(room)/F(cold) for F(cold), and F(room)/F(hot) for F(hot). Thus, $f_1(T)$ increases for cold temperatures and decreases for hot temperatures, thereby generating the same flow as at room temperature for the total range of temperatures from winter to summer. Such experimental testing enables the determination of the functional relationship $f_1(T)$ for the selected lubricant and the locomotive used.

Field tests are necessary for different tonnage trains to determine the correct relationship between total tonnage of a train and the correct quantity of lubricant for each. The lubricant should be applied at different %PWM for a given train. The correct %PWM is determined by measuring the adhesion coefficient on top of the rail after the train has passed. When 80% value of dry rail adhesion is reached the value of the corresponding %PWM should be selected for the tonnage of the train tested. During these tests, the temperature, curve and speed are kept the same. In this fashion, lubrication rates are established for tonnages from 1,000 to 30,000 tons (for example) and a table of lube rate factors for different tonnages of the train is made. This table, represented by $f_2(w)$, is stored in the computer memory for determining accurately the PWM or %PWM for lube application. Thus the improved formula for lube application becomes $\%\ PWM=K*R_D*f_1(T_L)*V*f_2(w)$.

The computer calculates the pulse width, which can be converted to %PWM (36 in FIG. 2). Time period $\tau$ is divided into a large number of parts (such as 32,780). The computer 29 calculates the parts for which the solenoid is open. This defines the amount of lubricant that comes out in one period $\tau$ or one pulse. Since the pressure is constant, the flow is defined by this pulse width (PWM) for a given temperature. The terms in the above relation for %PWM are all numbers, i.e., they do not have units. So %PWM is a number, say, for example 3278. In this example, 3278/32780 is the fraction of period $\tau$ for which the solenoid valve is open. %PWM in this example is 10%.

The baseline of flow is at room temperature. If the temperature increases, viscosity of the lubricant drops. The flow, however, is kept the same as at room temperature by correspondingly reducing PWM so that the flow is still the same. So, as the temperature changes, the PWM will change in such a way that flow is still the same even though viscosity has changed. There is a table developed for each parameter in computer units, so that for a given temperature, curve, speed and tonnage, when all elements are multiplied, the number 3278, in the above example, is obtained.

Figure 4:
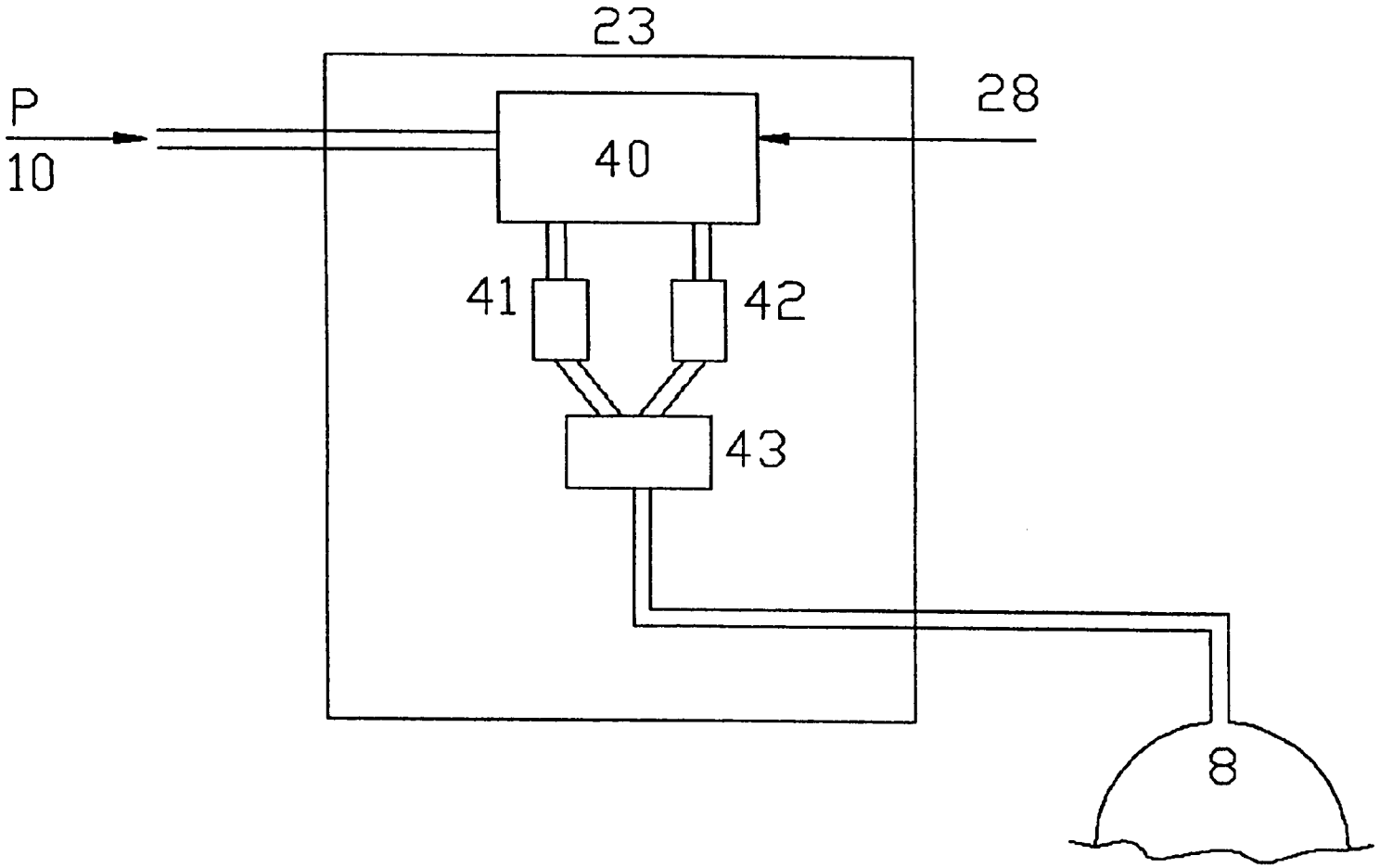
FIG. 4 shows an electromechanical arrangement to change tank pressure.

If the train is operating in temperatures which are colder than the lowest temperatures accommodated by using 100% PWM, the present invention incorporates a feedback control of pressure "p" 11 in the lube tank by raising it to a higher value using an electronic pressure regulator 23, so that the cold viscous lube can flow adequately to reach the design values of lube application within 100% PWM of the solenoid valve. The electronic pressure regulators are expensive. Therefore, a less costly design is shown in FIG. 4 which uses two conventional mechanical pressure regulators 41 and 42 which are connected by a two way solenoid valve 40. This solenoid is triggered by an input from the computer 29 to change the solenoid being used as the temperature changes by a large amount. Each pressure regulator is set at a pre-selected pressure value suitable for the two ranges of temperature needed from very cold to very warm. The two regulators 41 and 42 are connected through a Y-connection 43 to the tank or reservoir 8.

Figure 5:
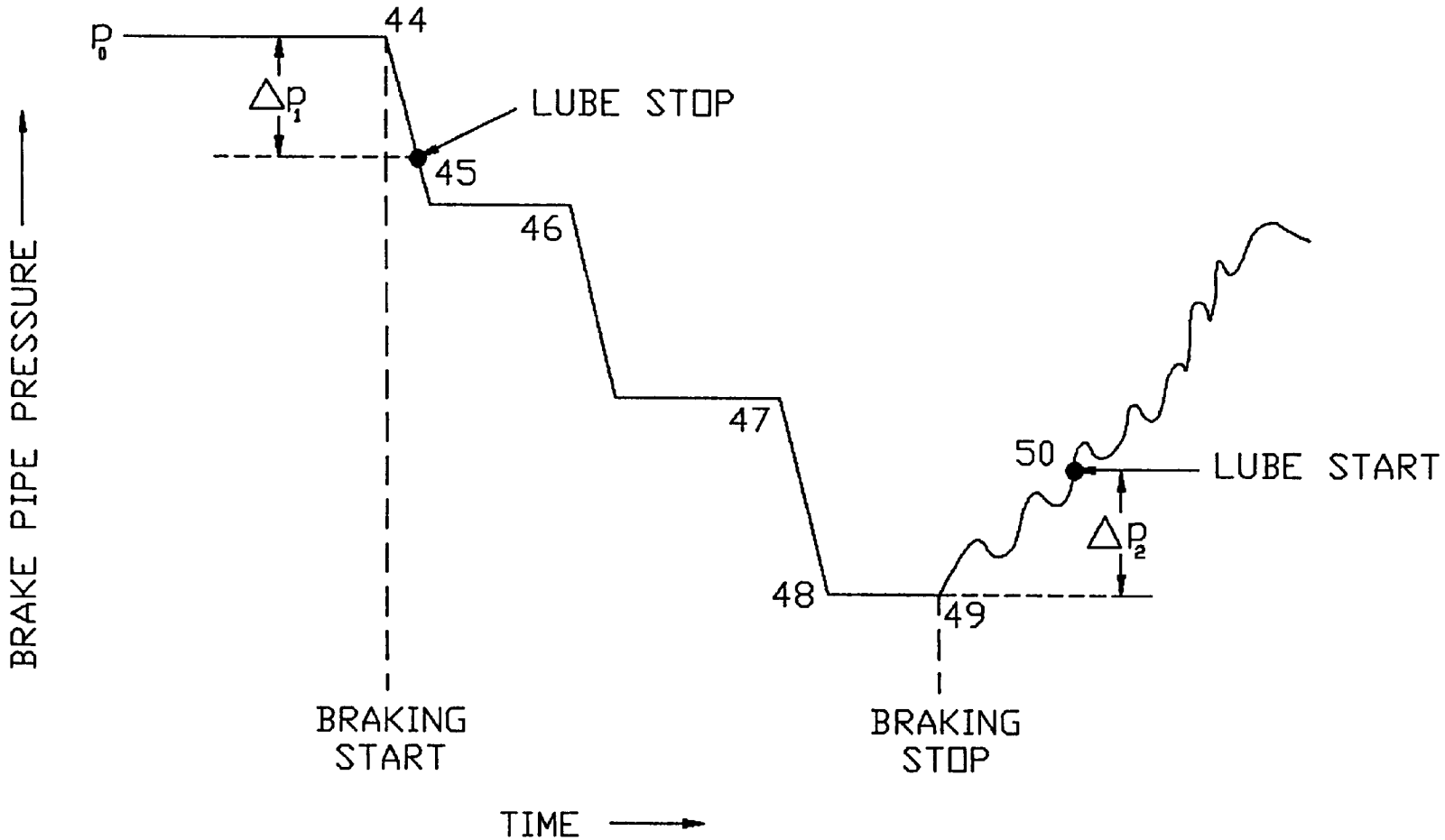
FIG. 5 shows how lube application stops with brake application and then restarts with brake release.

Another important issue, which is a part of this invention, is the method of stopping lube application when brakes are applied and resuming lube application when brakes are released. This is shown in FIG. 5 as a plot of brake pipe pressure versus time. The air brake line pressure $p_0$ can fluctuate within a small range due to small air leaks and the compressor repressurizing the air tank. These fluctuations should not be mistaken for an air brake application or release. In FIG. 1, a pressure transducer 19 is shown. It gathers the current air line pressure $p_0$ (FIG. 5) and keeps track of it treating it as unchanged. When the drop of air line pressure exceeds a predefined value $\Delta p_1$, the computer recognizes that the brakes have been applied. In FIG. 5, braking starts at 44 but the computer recognizes the brake application at 45 when the lube application is stopped. In FIG. 5, the air brake application is shown for illustration purposes in three stages of air line pressure drops; first at 44, then at 46 and finally at 47. In actual use, the air brake may be applied differently. In all cases, however, the air brake application is associated with the pressure drop of the air brake line. These changes of pressure (at 44, 46 and 47 in FIG. 5) are all pressure drops. So, the computer recognizes them as continuing air brake application. At 48, the air pressure is not reduced any more. At 49, air brake application is stopped and the brake pipe pressure starts rising. The computer does not recognize the small oscillations according to the program. Only when the pressure has risen by a predefined value $\Delta p_2$ at 50 does the computer recognize the brake release and the lube application is resumed. The pressures $\Delta p_1$ and $\Delta p_2$ are program and railroad system selectable.

Another part of this invention is the use of a check valve 24, 30 set at several psi pressure (1–15 psi) immediately before the lube application nozzle, between the pulsing solenoid valve and the application nozzle 25, 31. Use of this check valve improves the hydraulic response time of lube application or stoppage. It also improves the lube jet in that it becomes a solid jet rather than a slow drip during the interval between the closed and open cycles of the solenoid valves.

What is claimed is:

1. In a railroad locomotive of the type having a nozzle for applying a lubricant to the top of a rail behind the last axle of the locomotive, a lubricant supply tank, a lubricant conduit connecting the supply tank to the nozzle, means for pressurizing the lubricant supply tank, and computer means for controlling the lubricant flow rate, an improved method of controlling the lubricant flow rate comprising the steps of:

a) placing at least one solenoid valve in the lubricant conduit;

b) defining a series of sequential time windows, each time window having a predetermined time period;

c) calculating in the computer for each time window a single valve-open time duration that will produce a desired lubricant flow rate, said time duration being a percentage of the defined time window; and d) opening the solenoid valve for said single time duration during each time window.

2. The method of claim 1 further comprising the step of controlling the pressurizing means to provide a regulated pressure in the lubricant supply tank.

3. The method of claim 1 further comprising the step of providing to the computer an indication of the application of the dynamic brakes of the locomotive and selectively shutting off the flow of lubricant when the dynamic brakes are applied.

4. The method of claim 1 further characterized in that said time duration is dependent upon at least one operating input of the locomotive.

5. In a railroad locomotive an improved assembly for applying a lubricant to the top of a rail, comprising a nozzle connected to the locomotive and arranged for applying the lubricant to the top of a rail behind the last axle of the locomotive, a lubricant supply tank mounted on the locomotive, a lubricant conduit connecting the supply tank to the nozzle, means on the locomotive for pressurizing the lubricant supply tank, a solenoid valve in the lubricant conduit, a computer for controlling the solenoid valve and thereby controlling the flow of lubricant from the lubricant supply tank to the nozzle, a check valve in the lubricant conduit immediately upstream of the nozzle, between the solenoid valve and the nozzle.

6. The lubricant applying assembly of claim 5 wherein the check valve is set at between 1 and 15 psi.

7. In a railroad locomotive of the type having a nozzle for applying a lubricant to the top of a rail behind the last axle of the locomotive, a lubricant supply tank, a lubricant conduit connecting the supply tank to the nozzle, means for pressurizing the lubricant supply tank, a solenoid valve in the lubricant conduit, and a computer for controlling the flow of lubricant, the improvement comprising a method of increasing hydraulic response time of lube application comprising the step of placing a check valve in the conduit intermediate the nozzle and the solenoid valve.

8. The method of claim 7 further including the step of setting the check valve at between 1 and 15 psi.

* * * * *